US006094925A

United States Patent [19]

Arshansky et al.

[11] Patent Number: 6,094,925

[45] **Date of Patent: *Aug. 1, 2000**

[54] CROSSOVER WARM LIQUID DEFROST REFRIGERATION SYSTEM

[75] Inventors: Yakov Arshansky, Conyers; David K. Hinde, Rex, both of Ga.

[73] Assignee: Delaware Capital Formation, Inc., Wilmington, Del.

[21] Appl. No.: 09/240,072

[22] Filed: Jan. 29, 1999

[51] Int. Cl.[7] ..... F25B 47/02

[52] U.S. Cl. ..... 62/81; 62/151; 62/185; 62/277

[58] Field of Search ..... 62/155, 151, 156, 62/152, 81, 277, 278, 201, 185, 434, 435, 436

[56] References Cited

U.S. PATENT DOCUMENTS

| | | | |
|---|---|---|---|
| 2,657,546 | 11/1953 | Smith | 62/277 X |
| 3,675,441 | 7/1972 | Perez | 62/278 |
| 4,646,539 | 3/1987 | Taylor | 62/278 |
| 5,727,393 | 3/1998 | Mahmoudzadeh | 62/81 |
| 5,921,092 | 7/1999 | Behr et al. | 62/81 |

*Primary Examiner*—Harry B. Tanner
*Attorney, Agent, or Firm*—Thomas, Kayden, Horstemeyer & Risley

[57] ABSTRACT

A crossover warm liquid defrost refrigeration system (10) having a medium temperature side (12) for cooling refrigerated goods and a low temperature side (14) for cooling frozen goods. The medium temperature side has a primary refrigeration loop (16) and a secondary refrigeration loop (18). The low temperature side also has a primary refrigeration loop (46) and a secondary refrigeration loop (48). Further included in the refrigeration system is a low temperature defrost heat exchanger (28) that is connected to the primary refrigeration loop of the medium temperature side and the secondary refrigeration loop of the low temperature side such that coolant from the low temperature side secondary refrigeration loop can be heated by the refrigerant of the medium temperature side, and then transported to the low temperature side refrigerated space heat exchanger (64) to melt any frost formed thereon. Typically, the system further includes a medium temperature defrost heat exchanger (58) that is connected to the primary refrigeration loop of the low temperature side and the secondary refrigeration loop of the medium temperature side such that coolant from the medium temperature side secondary refrigeration loop can be heated by the refrigerant of the low temperature side for defrosting the medium temperature refrigerated space heat exchanger (34).

36 Claims, 2 Drawing Sheets

CROSSOVER WARM LIQUID DEFROST REFRIGERATION SYSTEM

FIELD OF THE INVENTION

The invention relates generally to a refrigeration system that uses a warm liquid defrost cycle. More particularly, the invention relates to a secondary coolant refrigeration system with crossover warm liquid defrost having a medium temperature side and a low temperature side which are in cross-communication with one another such that heat from the medium temperature side is used to warm the defrost liquid for the refrigerated spaces of the low temperature side, and heat from the low temperature side is used to warm the defrost liquid for the refrigerated spaces of the medium temperature side.

BACKGROUND OF THE INVENTION

Present day food stores such as supermarkets and convenience stores typically use relatively high capacity refrigeration systems to keep their refrigerated and frozen food products cold. The two most common types of refrigeration systems may be generally designated as direct expansion systems and secondary coolant systems. In direct expansion systems, a two-phase, vapor-compression refrigeration loop is used which normally includes an evaporator positioned inside the refrigerated space that absorbs heat from the space, thereby cooling the space to the desired temperature. In secondary coolant systems, a primary refrigeration loop and a secondary refrigeration loop are used in conjunction to cool the refrigerated space. The primary loop of the system is typically a vapor-compression system similar to that used in direct expansion systems and usually comprises a compressor, condenser, receiver, and an expansion device. The secondary loop is typically a single-phase system and comprises a pump and a heat exchanger that is disposed within the refrigerated space to absorb heat therefrom. The two loops of secondary coolant systems thermally communicate with each other through a chiller which provides for heat transfer between the primary and secondary loops.

Currently, there is a trend toward use of secondary coolant systems rather than direct expansion systems in that the amounts of primary refrigerant used in the refrigerated space can be minimized when a secondary coolant system is used, increasing safety to personnel and customers that interact with the refrigerated space. In addition, secondary coolant systems provide the advantage of improving temperature stability and humidity within the refrigerated space.

As is well known in the art, moisture contained within the refrigerated space condenses on the heat exchanger used in the refrigerated space and freezes thereon to form frost. This frost greatly decreases the cooling efficiency of the refrigeration system and, if left to accumulate, can even block the flow of air through the evaporator or heat exchanger to diminish the heat exchange capacity of the refrigeration system. Several methods of removing this frost, known as defrosting, have been developed in the refrigeration arts. The simplest method is so called "off-cycle" defrost in which the refrigeration cycle is simply discontinued and the heat of the surrounding air meets the frost. In another method, the evaporator or heat exchanger is electrically heated to melt the frost. In direct expansion systems, typically the hot gas of the refrigerant discharged by the compressor is used to melt the frost. In yet another method, the secondary coolant system is defrosted by passing warm coolant through the refrigerated space heat exchanger for a predetermined period of time and/or temperature, so that the frost formed thereon melts and drains away. Of these several methods, liquid defrost is generally preferred in the art for several reasons. First, warm liquid defrost is safer than electrical and hot gas defrost in that it is less stressful on the refrigeration system. In addition, warm liquid defrost is more efficient than electrical and hot gas defrost and therefore does not result in a large degree of warming of the refrigerated space. This avoids food spoilage and also increases system efficiency in that a large degree of cooling is not necessary to bring the refrigerated space back to its standard operating temperature.

The most common methods of heating the liquid supplied to the coils located in the refrigeration space typically utilize the hot gas of the refrigeration system that is discharged by compressor. In particular, the hot gas from the compressor is diverted to a gas-to-liquid heat exchanger, often referred to as a heat reclamation tank, in fluid communication with the secondary coolant in which the coolant is heated so it then can be delivered to the refrigerated space heat exchanger.

Although typically providing enough heat energy to adequately defrost the coils of the refrigerated space evaporator or heat exchanger, usage of gas-to-liquid heat exchange presents several disadvantages. Specifically, gas has a relatively low coefficient of heat transfer in comparison to liquid. Due to this relatively low coefficient of heat transfer, the defrost liquid often must be prepared in advance of the defrost cycle to ensure adequate heating of the refrigeration space coils. Accordingly, defrost in many systems cannot be had "on demand." Moreover, the relatively low coefficient of heat transfer of the gas mandates relatively large heat transfer surface areas between the gas side and the liquid side of the heat reclamation tank or other heat exchanger. To provide this large heat transfer surface area, the heat reclamation tank or other heat exchanger typically must be large in size and, consequently, is quite expensive. Additionally, usage of heat reclamation tanks often requires the usage of other expensive equipment such as valves and control systems which are used to control operation of the reclamation tank.

From the above, it can be appreciated that it would be desirable to have a refrigeration system which utilizes warm liquid defrosting of the refrigerated space coils which is not dependent upon the hot discharge gas from the compressor and gas-to-liquid heat exchange.

Where the refrigeration system comprises a medium temperature side for cooling refrigerated goods and a low temperature side for cooling frozen goods, typically the discharge gases of the medium temperature and low temperature sides are used separately to warm the coolants of the medium temperature and low temperature sides, respectively, for defrost.

Although typically providing enough heat energy to adequately defrost the coils of the refrigerated space evaporator or heat exchanger, separate coolant warming on the medium and low temperature sides can be inefficient. This inefficiency is apparent when the individual heating capacities of the medium and low temperature sides are analyzed.

Because of the different respective temperatures needed in the refrigerated spaces of the medium and low temperature sides, the temperature of the warm liquid needed for defrost typically is different for these two sides. For example, a refrigerated space may require coolant at a temperature of approximately 20° F. flowing through the refrigerated space heat exchanger and exiting at 25° F. to maintain the desired temperature therein. While the low temperature refrigerated spaces may require a coolant at a temperature of approximately −20° F. and exiting at approximately −15° F. to maintain the desired temperature therein. These respective temperatures mean that typically approximately 50° F. to 55° F. coolant is needed for defrost on the medium temperature side while typically approximately 70° F. to 75° F. coolant is needed for defrost on the low temperature side. Accordingly, the temperature change required to heat defrost liquid for the medium temperature side is approximately 30° F. (the difference between 25° F. and 55° F.) while the temperature change required to heat defrost liquid for the low temperature side is approximately 90° F. (the difference between −15° F. and 75° F.).

From the above, it can be appreciated that the temperature change of the coolant needed for defrost on the low temperature side is three times that needed on the medium temperature side. Typically, however, most refrigeration applications require three times as much medium temperature cooling as low temperature cooling. This means that the medium temperature side of the refrigeration system must have three times the mass flow of the low temperature side. Accordingly, conventional systems typically have a low temperature side with only one third the heating capacity of the medium temperature side, but which requires three times the temperature change of coolant for defrost. It is this uneven balance of heating capacity and required temperature change that creates the aforementioned inefficiency of conventional refrigeration systems.

It therefore can be appreciated that it would be desirable to have a warm liquid refrigeration system which utilizes the relatively large heating capacity of the medium temperature side of the refrigeration system to heat the defrost liquid for the low temperature side of the refrigeration system.

SUMMARY OF THE INVENTION

The present invention comprises a secondary coolant refrigeration system with crossover warm liquid defrost refrigeration system having a medium temperature side for cooling refrigerated goods and a low temperature side for cooling frozen goods. The medium temperature side normally has a primary refrigeration loop including a compressor, a condenser, an expansion device, and a first side of a medium temperature chiller, and a secondary refrigeration loop including a pump, a medium temperature refrigerated space heat exchanger, and a second side of the medium temperature chiller. Similarly, the low temperature side normally has a primary refrigeration loop including a compressor, a condenser, an expansion device, and a first side of a low temperature chiller, and a secondary refrigeration loop including a pump, a low temperature refrigerated space heat exchanger, and a second side of the low temperature chiller. Typically, further included in the refrigeration system is a low temperature defrost heat exchanger having a hot side and a cold side. The hot side of the low temperature defrost heat exchanger is connected to the primary refrigeration loop of the medium temperature side such that high temperature refrigerant from the medium temperature side can flow through the hot side of the low temperature defrost heat exchanger. The cold side of the low temperature defrost heat exchanger is connected to the secondary refrigeration loop of the low temperature side such that coolant from the low temperature side can be selectively transported from the low temperature side secondary refrigeration loop through the cold side of the low temperature defrost heat exchanger. In addition, the cold side of the low temperature defrost heat exchanger is selectively, fluidly communicable with the low temperature refrigerated space heat exchanger.

Configured in this manner, coolant from the low temperature secondary refrigeration loop flows through the cold side of the low temperature defrost heat exchanger during a defrost cycle, is heated by the primary refrigerant of the medium temperature side flowing through the hot side of the low temperature defrost heat exchanger, and then is transported to the low temperature refrigerated space heat exchanger to melt any frost formed thereon.

In preferred embodiment, the refrigeration system further comprises a medium temperature defrost heat exchanger having a hot side connected to the primary refrigeration loop of the low temperature side such that high temperature refrigerant from the low temperature side can flow through the hot side of the medium temperature defrost heat exchanger, and having a cold side connected to the secondary refrigeration loop of the medium temperature side such that coolant from the medium temperature side can be selectively transported from the medium temperature side secondary refrigeration loop through the cold side of the medium temperature defrost heat exchanger. The cold side of the medium temperature defrost heat exchanger is further selectively, fluidly communicable with the medium temperature refrigerated space heat exchanger such that when a medium temperature side defrost cycle is operated, coolant from the medium temperature side secondary refrigeration loop flows through the cold side of the medium temperature defrost heat exchanger, is heated by the primary refrigerant of the low temperature side flowing through the hot side of the medium defrost heat exchanger, and then is transported to the medium temperature side refrigerated space heat exchanger to melt any frost formed on the medium temperature refrigerated space heat exchanger.

The refrigeration system described above presents many advantages over conventional refrigeration systems in current use today. In particular, the system takes advantage of the relatively large heating capacity of the medium temperature side of the refrigeration system to heat the coolant of the low temperature side secondary loop for defrost to increase system operation efficiency.

The objects, features, and advantages of this invention will become more apparent upon reading the following specification, when taken in conjunction with the accompanying drawings. It is intended that all such additional features and advantages be included therein with the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
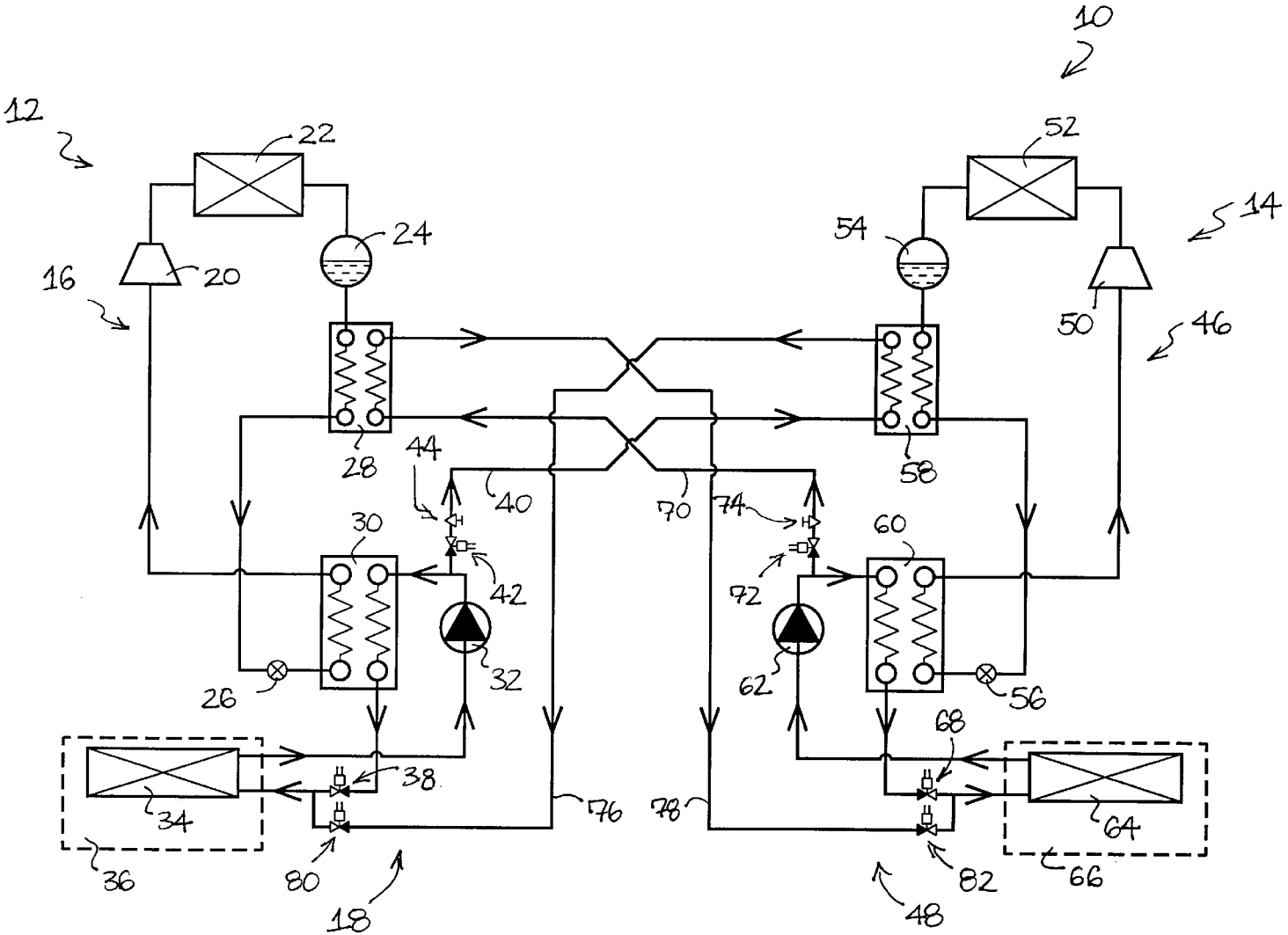
FIG. 1 is a schematic view of a first embodiment of a refrigeration system constructed in accordance to the present invention.
Figure 2:
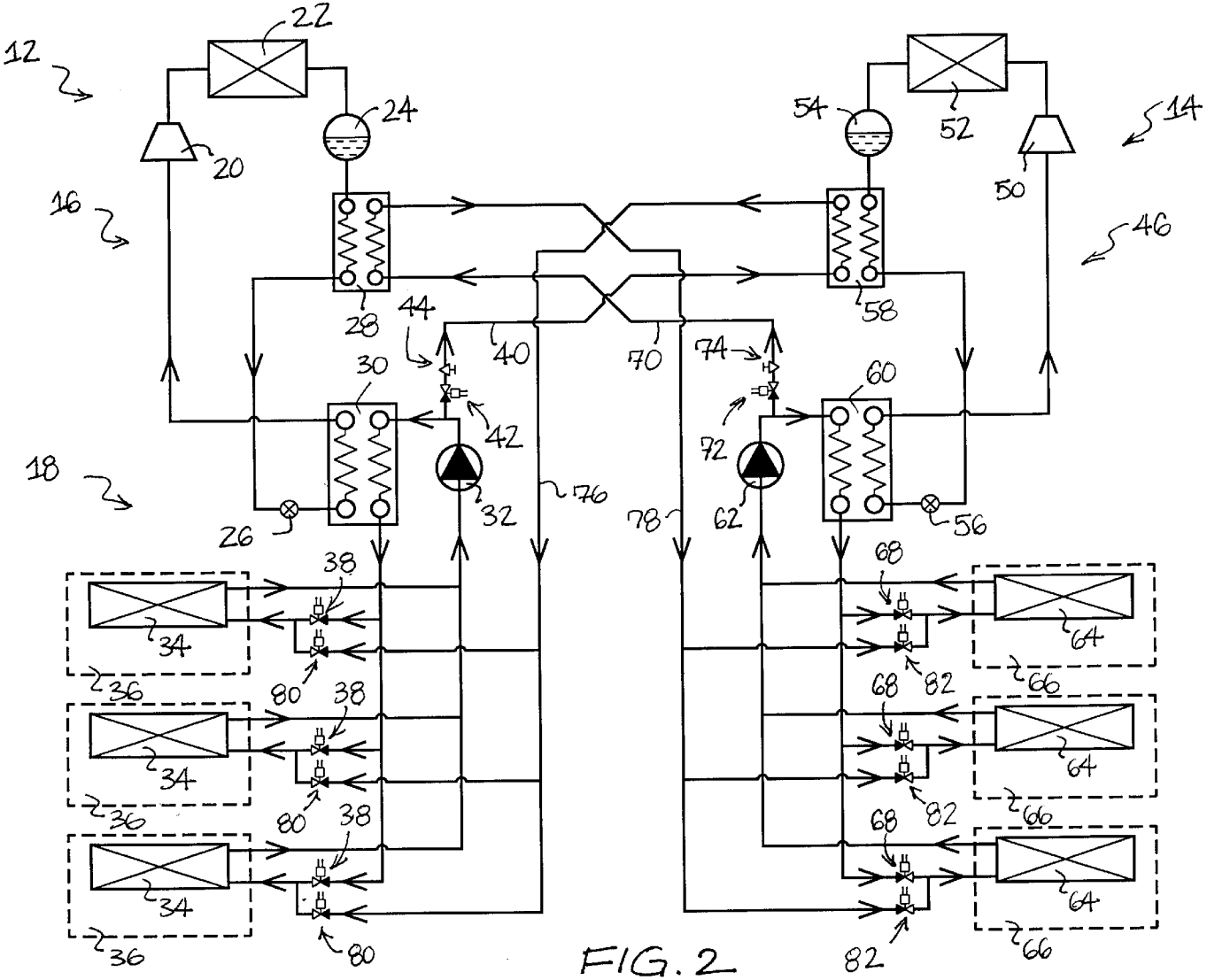
FIG. 2 is a schematic view of a second embodiment of a refrigeration system constructed in accordance to the present invention.

Referring now in more detail to the drawings, in which like numerals indicate like parts throughout the several views, FIGS. 1 and 2 illustrate refrigeration systems constructed in accordance to the present invention.

FIG. 1 illustrates, in schematic view, a first embodiment of a refrigeration system 10. As indicated in this figure, the refrigeration system comprises a medium temperature side 12 and a low temperature side 14. Normally, each side of the refrigeration system is constructed as a secondary coolant system having a primary refrigeration loop and a secondary refrigeration loop, although it will be understood that either the medium temperature side or the low temperature side alone could be a secondary coolant system and the other a direct expansion system.

Beginning with the medium temperature side 12 of the refrigeration system 10 shown in FIG. 1, the medium temperature side comprises a primary refrigeration loop or primary loop 16 and a secondary refrigeration loop or secondary loop 18. The primary loop typically is formed as a two-phase, vapor-compression loop and therefore normally comprises a compressor 20, a condenser 22, a receiver 24, and an expansion device 26. As is known in the art, the compressor 20 receives gas refrigerant circulating in the system and compresses it, increasing the pressure and temperature of the gas. Although depicted as a single compressor 20, it will be understood by those having ordinary skill in the art that several compressors arranged in series and/or in parallel could be used depending upon the specific refrigeration requirements of the installation site.

The condenser 22 receives the high pressure, high temperature gas refrigerant from the compressor 20 and removes heat therefrom at a generally constant pressure until the refrigerant gas condenses into a saturated liquid which is collected in the receiver 24. Normally positioned downstream from the receiver 24 is a low temperature defrost heat exchanger 28. Although a liquid-to-liquid defrost heat exchanger is depicted and preferred, it will be appreciated other heat transfer equipment, such as a discharge gas heat reclamation tank, alternatively could be used. However, the particular advantages of using a liquid-to-liquid defrost heat exchanger are detailed in co-pending U.S. patent application Ser. No. 09/239,877 filed on Jan. 29, 1999. When a liquid-to-liquid defrost heat exchanger is used, it preferably takes the form of a plate heat exchanger having a hot side and a cold side.

The expansion device 26 can take any one of a variety of forms including a thermostatic expansion valve, electronic expansion valve, hand expansion valve, capillary tube, or other means for expanding the refrigerant. Positioned between the expansion device 26 and the compressor 20 in the primary loop is a medium temperature chiller 30. As is discussed in more detail below, the chiller includes a first side in fluid communication with the primary loop 16 and a second side in fluid communication with the secondary loop 18 such that the primary loop and the secondary loop are in thermal communication with each other.

The secondary loop 18 typically is formed as a single-phase loop that comprises a pump 32 which propels the coolant through the secondary loop and a medium temperature refrigerated space heat exchanger 34 that is disposed within the medium temperature refrigerated space 36. Although a single pump 32 is shown in the figure, it is to be understood that several pumps could be used in series or parallel to circulate the coolant through the secondary loop. The medium temperature refrigerated space heat exchanger 34 can take one of many forms. Irrespective of the type of heat exchanger used, the medium temperature refrigerated space heat exchanger usually comprises one or more coils having a plurality of fins (not shown) which increase heat transfer from the medium temperature refrigerated space to the coils and the coolant flowing therethrough. Air typically is forced across the fins of the coils, for example, by electric fans (not shown) to further increase the absorption of heat from the medium temperature refrigerated space. The medium temperature refrigerated space 36 can be any space which is desired to be cooled to a temperature of approximately 20° F. to 60° F. such as one or more refrigerated display cases. Although only one medium temperature refrigerated space is shown in FIG. 1, several such refrigerated spaces 36 can be cooled simultaneously as indicated in FIG. 2.

The medium temperature chiller 30 preferably takes the form of a plate heat exchanger in which the first side and the second side of the chiller are arranged as alternating spaces formed between the plates of the chiller. Arranged in this manner, the first and second sides of the chiller 30 thermally communicate such that heat from the secondary loop 18 is transferred to the primary loop 16 of the system. Typically positioned along the secondary loop between the chiller 30 and the medium temperature refrigerated space heat exchanger 34 is a first coolant shut-off valve 38. As is described below, the first coolant shut-off valve serves to stop the flow of coolant to the medium temperature refrigerated space heat exchanger 34 during a defrost cycle. Where more than one medium temperature refrigerated space 36 is used, as shown in FIG. 2, one shut-off valve 38 is used for each refrigerated space so that the refrigerated spaces can be alternately defrosted without shutting down cooling of the other refrigerated spaces.

As is evident from FIG. 1, the medium temperature side 12 of the refrigeration system 10 also typically comprises a first crossover coolant supply line 40 that is connected to the secondary loop 18 at a point downstream of the pump 32. This supply line includes a first diverting valve 42 which can be opened and closed to selectively operate the defrost cycle for the medium temperature refrigerated space heat exchanger. Normally, the first diverting valve 42 takes the form of a solenoid valve which is electrically actuated by a microprocessor driven control system (not shown). In addition to the diverting valve 42, the first crossover coolant supply line 40 normally is provided with a first balance valve 44 which, as is discussed below, helps maintain the balance of the flow of coolant through the coolant supply line during defrost cycles.

The low temperature side 14 of the refrigeration system 10 typically is similar in form to the medium temperature side 12 of the refrigeration system 10 and, therefore, normally comprises a primary refrigeration loop or primary loop 46 and a secondary refrigeration loop or secondary loop 48. However, it will be understood by persons having ordinary skill in the art that, as identified above, the low temperature side 14 (or alternatively the medium temperature side 12) could be formed as a conventional direct expansion system, if desired. In situations in which only one side of the whole system is a direct expansion system, crossover warm liquid defrost will only be available for one side of the whole system. It is to be appreciated that the preferences and alternatives identified with respect to the components of the medium temperature side of the refrigeration system similarly apply to those of the low temperature side of the refrigeration system. When the low temperature side 14 is formed as a secondary coolant system, the primary loop typically is formed as a two-phase, vapor-compression loop and therefore normally comprises a compressor 50, a condenser 52, a receiver 54, and an expansion device 56. Normally positioned downstream from the receiver 54 is a medium temperature defrost heat exchanger 58. Although a liquid-to-liquid heat exchanger is preferred for the reasons cited above, it will be appreciated other heat transfer equipment, such as a discharge gas heat reclamation tank, alternatively could be used. When a liquid-to-liquid defrost heat exchanger is used, it preferably takes the form of a plate heat exchanger having a hot side and a cold side.

Positioned between the expansion device 56 and the compressor 50 in the primary loop 46 is a low temperature chiller 60 which includes a first side in fluid communication with the primary loop 46 and a second side in fluid communication with the secondary loop 48 such that the primary loop and the secondary loop are in thermal communication with each other. The secondary loop 48 typically is formed as a single-phase loop that comprises a pump 62 which propels the coolant through the secondary loop and a low temperature refrigerated space heat exchanger 64 that is disposed within the low temperature refrigerated space 66. Similar to the medium temperature refrigerated space heat exchanger 34, the low temperature refrigerated space heat exchanger 64 usually comprises one or more coils having a plurality of fins (not shown) which increase heat transfer from the low temperature refrigerated space to the coils and the coolant flowing therethrough. Although only one low temperature refrigerated space is shown in FIG. 1, several such refrigerated spaces 66 can be cooled as indicated in FIG. 2.

The low temperature chiller 60 preferably takes the form of a plate heat exchanger in which the first side and the second side of the chiller are arranged as alternating spaces formed between the plates of the chiller. Configured in this manner, the first and second sides of the chiller 60 thermally communicate such that heat from the secondary loop 48 is transferred to the primary loop 46 of the system. Typically positioned along the secondary loop between the chiller 60 and the low temperature refrigerated space heat exchanger 64 is a second coolant shut-off valve 68 which stops the flow of coolant to the low temperature refrigerated space heat exchanger 34 during a defrost cycle. Where more than one low temperature refrigerated space 66 is used, as shown in FIG. 2, one shut-off valve 68 is used for each low temperature refrigerated space so that the refrigerated spaces can be alternately defrosted without shutting down cooling of the other refrigerated spaces.

The low temperature side 14 of the refrigeration system 10 further comprises a second crossover coolant supply line 70 that is connected to the secondary loop 48 at a point downstream of the pump 62. This supply line includes a second diverting valve 72 which can be opened and closed to selectively operate the defrost cycle for the low temperature refrigerated space heat exchanger 64. The second crossover coolant supply line 70 normally is provided with a second balance valve 74 which helps maintain the balance of the flow of coolant through the coolant supply line during defrost cycles.

As shown in FIG. 1, the first crossover coolant supply line 40 connects the secondary loop 14 of the medium temperature side 12 to the medium temperature defrost heat exchanger 58. Similarly, the second crossover coolant supply line 70 connects the secondary loop 48 of the low temperature side 14 to the low temperature defrost heat exchanger 28. Typically, both the medium and low temperature defrost heat exchangers 58 and 28 take the form of plate heat exchangers having hot (primary loop) and cold (secondary loop) sides that are arranged as alternating spaces formed between the plates of the heat exchanger.

The low temperature defrost heat exchanger 28 is positioned between the receiver 24 and the expansion device 26 of the medium temperature side primary loop 16. Likewise, the medium temperature defrost heat exchanger 58 is positioned between the receiver 54 and the expansion device 56 of the low temperature side primary loop 46. Arranged in this manner, coolant propelled by the pump 32 of the medium temperature side 18 can flow through the cold side of the medium temperature defrost heat exchanger 58 and coolant propelled by the pump 62 of the low temperature side 48 can flow through the cold side of the low temperature defrost heat exchanger 28. When flowing through these respective defrost heat exchangers, the coolants are heated for defrosting of the low and medium temperature refrigerated space heat exchangers, respectively. It is to be noted that, as described above, it is the high temperature liquid refrigerant of the medium temperature side primary loop that is used to heat the low temperature coolant of the low temperature side secondary loop and vice versa, providing for cross-communication of the medium and low temperature sides. Normally, the heated coolant of each system is delivered to the medium and low temperature refrigerated space heat exchangers with first and second warm liquid supply lines 76 and 78, respectively. Included in these supply lines are first and second warm liquid supply valves 80 and 82, respectively, which are used to open the flow of warm coolant to the respective refrigerated space heat exchangers 34 and 64, during defrost cycles.

OPERATION

The primary components of the refrigeration system having been described above, the operation of the refrigeration system will now be discussed. It is to be noted that the specific temperature ranges and equipment mentioned herein are provided for purposes of example only. Those having ordinary skill in the art will appreciate that alternative temperature ranges and equipment may be used depending upon the particular application in which the refrigeration system is to be used.

When the refrigeration system 10 is operating, refrigerant circulates through the primary loops of both the medium and low temperature sides. In both primary loops, low pressure, superheated refrigerant gas enters the compressors 20 and 50 and is compressed to raise the pressure and temperature of the gas. On the medium temperature side, refrigerant enters the compressor 20 at a temperature of approximately 15° F. to 65° F. and exits the compressor at a temperature of approximately 100° F. to 250° F. On the low temperature side, refrigerant enters the compressor 50 at a temperature of approximately −20° F. to 40° F. and exits the compressor at a temperature of approximately 100° F. to 250° F. The high pressure, high temperature gas refrigerants then pass from the compressors 20 and 50 to the condensers 22 and 52, respectively, where the heat energy contained therein is removed at a generally constant pressure until the refrigerants become saturated liquids at a temperature of approximately 50° F. to 115° F. on each side. These refrigerants collect in the receivers 24 and 54 before passing through the low and medium temperature defrost heat exchanges 28 and 58, respectively. Although use of the receivers 24 and 54 is preferred, it is to be understood that the system described herein functions properly without these receivers and that the receivers therefore are optional. When neither side is in a defrost cycle, little or no heat exchange occurs in the defrost heat exchanger 28 and 58.

After passing through the defrost heat exchangers 28 and 58, the liquid refrigerants are transformed to low pressure gas/liquid mixtures by passing through the expansion devices 26 and 56, respectively. The gas/liquid mixtures then pass through the second sides of the chillers 30 and 60 where they absorb heat from the coolants flowing through the first sides of chillers 30 and 60, and vaporize to assume the low pressure, saturated gas states found upstream of the compressors 20 and 50.

In both secondary loops, relatively low pressure coolants enter the pumps 32 and 62 which propel the coolants through the second sides of the chillers 30 and 60. As described above, heat is removed from the coolants through heat exchange with the refrigerants flowing through the first sides of the chillers. Typically, this heat exchange results in a coolant temperature of approximately 0° F. to 30° F. on the medium temperature side and a coolant temperature of approximately −30° F. to 0° F. on the low temperature side of the refrigeration system. From this point, the coolants flow through the medium and low temperature refrigerated space heat exchangers 34 and 64, respectively.

After the system has been running in the aforementioned manner for a period of time, frost begins to build on the refrigerated space heat exchangers' coils. To remove this frost, the refrigeration system switches over to defrost cycles in which warm liquid (coolant) is provided to the medium and/or low temperature refrigerated space heat exchangers to melt the frost so that it can be drained away. Although capable of alternative configurations, the refrigeration system typically includes a microprocessor which controls the refrigeration system such that defrost cycles automatically will be conducted on a pre-programmed schedule. Depending upon the particular arrangement of the system, each refrigerated space will normally run approximately one to six defrost cycles per day of use. It is to be noted that, although the refrigerated system is described as including a microprocessor control system, manually or otherwise activated defrost cycles are not outside the purview of the present invention.

When a defrost cycle is initiated for the low temperature side of the refrigeration system, coolant is permitted to flow from the pump 62 through the second crossover coolant supply line 70 by opening the second diverting valve 72 and the second warm fluid supply valve 82 is opened. Once these valves have been opened, the coolant flows through the second crossover coolant supply line 70 and through the cold side of the low temperature defrost heat exchanger 28 where it is heated to a temperature of approximately 65° F. to 75° F. During this time, the second balance valve 74 serves to reduce the flow through the supply line to ensure proper heating of the coolant and soften the impact of this heating on the remainder of the system. The heated coolant then flows through the second warm liquid supply line 78 to the coils of the low temperature refrigerated space heat exchanger 64 to melt any frost formed thereon. After a predetermined amount of time has passed, typically between five to seven minutes, the second diverting valve 72 and the second warm liquid supply valve 82 are closed and normal operation of the system is resumed. The defrost cycle for the medium temperature side of the refrigeration system operates similarly to that of the low temperature side except that the coolant of the medium temperature secondary loop is heated by the medium temperature defrost heat exchanger 34 and, therefore, by the high temperature liquid refrigerant of the low temperature side primary loop.

The refrigeration system described above presents many advantages over conventional refrigeration systems in current use today. In particular, the system takes advantage of the relatively large capacity (i.e., mass flow) of the medium temperature side of the refrigeration system to heat the coolant of the low temperature side secondary loop for defrost. Operating in this manner, the efficiency of the system is increased in that the side having the greatest heating capacity (i.e., the medium temperature side) is used to heat the coolant needing the greatest temperature change for defrost (i.e., the low temperature side coolant). Because of this efficiency increase, it is believed that effective defrost can be obtained in less time and with less energy consumption, thereby substantially decreasing operational costs.

While preferred embodiments of the invention have been disclosed in detail in the foregoing description and drawings, it will be understood by those skilled in the art that variations and modifications thereof can be made without departing from the spirit and scope of the invention as set forth in the following claims. In particular, as identified above, it is to be understood that more conventional heating methods, such as use of a heat reclamation tank which utilizes high temperature discharge gas from the compressor, could be used to heat the coolant for defrost on one or both sides of the refrigeration system, if desired.

In addition, although the specific embodiments described herein provide for crossover defrost for both the medium temperature and low temperature sides of the systems, it is to be appreciated that either the medium temperature side alone or the low temperature side alone could be provided with crossover warm liquid defrost, if desired. Furthermore, it is to be understood that although both the medium temperature side and the low temperature side are described as secondary refrigeration systems, that both need not be for the system to operate correctly and in accordance with the present disclosure.

What is claimed is:

1. A warm liquid defrost refrigeration system comprising:

a medium temperature side including a medium temperature refrigerated space heat exchanger;

a low temperature side including a low temperature refrigerated space heat exchanger; and a defrost heat exchanger having a hot side and a cold side, said hot side of said defrost heat exchanger being connected to one of said medium temperature and said low temperature sides such that refrigerant from one of said sides can flow through said hot side of said defrost heat exchanger, said cold side of said defrost heat exchanger being connected to the other of said medium temperature and said low temperature sides such that coolant from said other of said sides can be selectively transported through said cold side of said refrigerated space heat exchanger and then through said defrost heat exchanger of said other of said sides;

wherein during a defrost cycle coolant from said other of said sides can flow through said cold side of said defrost heat exchanger, is heated by the refrigerant of said one of said sides flowing through said hot side of said defrost heat exchanger, and then is transported to said refrigerated space heat exchanger of said other of said sides to melt any frost formed thereon.

2. The refrigeration system of claim 1, wherein said medium temperature side is configured as a secondary coolant system having a primary refrigeration loop and a secondary refrigeration loop.

3. The refrigeration system of claim 1, wherein said low temperature side is configures as a secondary coolant system having a primary refrigeration loop and a secondary refrigeration loop.

4. The refrigeration system of claim 1, wherein said defrost heat exchanger is a low temperature defrost heat exchanger, said hot side of said low temperature defrost heat exchanger being connected to said medium temperature side of said system and said cold side of said low temperature defrost heat exchanger being connected to said low temperature side of said system such that coolant from said low temperature side of said system can be selectively transported through said cold side of said low temperature defrost heat exchanger and then through said low temperature refrigerated space heat exchanger to melt frost formed thereon.

5. The refrigeration system of claim 1, wherein said defrost heat exchanger is a medium temperature defrost heat exchanger, said hot side of said medium temperature defrost heat exchanger being connected to said low temperature side of said system and said cold side of said medium temperature defrost heat exchanger being connected to said medium temperature side of said system such that coolant from said medium temperature side of said system can be selectively transported through said cold side of said medium temperature defrost heat exchanger and then through said medium temperature refrigerated space heat exchanger to melt frost formed thereon.

6. A warm liquid defrost refrigeration system comprising:

a medium temperature side having a primary refrigeration loop and a secondary refrigeration loop including a medium temperature refrigerated space heat exchanger;

a low temperature side including a low temperature refrigerated space heat exchanger; and a low temperature defrost heat exchanger having a hot side and a cold side, said hot side of said low temperature defrost heat exchanger being connected to said primary refrigeration loop of said medium temperature side such that refrigerant from said medium temperature side can flow through said hot side of said low temperature defrost heat exchanger, said cold side of said low temperature defrost heat exchanger being connected to said low temperature side such that coolant from said low temperature side can be selectively transported from said low temperature side through said cold side of said low temperature defrost heat exchanger, said cold side of said low temperature defrost heat exchanger further being selectively, fluidly communicable with said low temperature refrigerated space heat exchanger;

wherein during a low temperature side defrost cycle coolant from said low temperature side secondary refrigeration loop can flow through said cold side of said low temperature defrost heat exchanger, is heated by the refrigerant of said medium temperature side flowing through said hot side of said low defrost heat exchanger, and then is transported to said low temperature side refrigerated space heat exchanger to melt any frost formed on said low temperature refrigerated space heat exchanger.

7. The refrigeration system of claim 6, wherein said low temperature side has a primary refrigeration loop and a secondary refrigeration loop, said low temperature refrigerated space heat exchanger forming part of said secondary refrigeration loop of said low temperature side.

8. The refrigeration system of claim 7, further comprising a medium temperature defrost heat exchanger having a hot side and a cold side, said hot side of said medium temperature defrost heat exchanger being connected to said primary refrigeration loop of said low temperature side such that refrigerant from said low temperature side can flow through said hot side of said medium temperature defrost heat exchanger, said cold side of said medium temperature defrost heat exchanger being connected to said secondary refrigeration loop of said medium temperature side such that coolant from said medium temperature side can be selectively transported from said medium temperature side secondary refrigeration loop through said cold side of said medium temperature defrost heat exchanger, said cold side of said medium temperature defrost heat exchanger further being selectively, fluidly communicable with said medium temperature refrigerated space heat exchanger;

wherein during a medium temperature side defrost cycle coolant from said medium temperature side secondary refrigeration loop can flow through said cold side of said medium temperature defrost heat exchanger, is heated by the liquid refrigerant of said low temperature side flowing through said hot side of said medium defrost heat exchanger, and then is transported to said medium temperature side refrigerated space heat exchanger to melt any frost formed on said medium temperature refrigerated space heat exchanger.

9. The refrigeration system of claim 8, wherein said secondary refrigeration loop of said medium temperature side connects to said cold side of said medium temperature defrost heat exchanger with a first crossover coolant supply line.

10. The refrigeration system of claim 9, wherein said first crossover coolant supply line includes a first diverting valve which can be opened or closed to selectively control the supply of coolant to said medium temperature defrost heat exchanger.

11. The refrigeration system of claim 8, wherein said cold side of said medium temperature defrost heat exchanger connects to said medium temperature refrigerated space heat exchanger with a first warm liquid supply line.

12. The refrigeration system of claim 11, wherein said first warm liquid supply line includes a first warm liquid supply valve which can be opened or closed to selectively control the supply of warm coolant to said medium temperature refrigerated space heat exchanger.

13. The refrigeration system of claim 8, wherein said secondary refrigeration loop of said medium temperature side includes a first coolant shut-off valve for stopping the flow of coolant to said medium temperature refrigerated space heat exchanger during a defrost cycle.

14. The refrigeration system of claim 6, wherein said low temperature side connects to said cold side of said low temperature defrost heat exchanger with a second crossover coolant supply line.

15. The refrigeration system of claim 14, wherein said second crossover coolant supply line includes a second diverting valve which can be opened or closed to selectively control the supply of coolant to said low temperature defrost heat exchanger.

16. The refrigeration system of claim 6, wherein said cold side of said low temperature defrost heat exchanger connects to said low temperature refrigerated space heat exchanger with a second warm liquid supply line.

17. The refrigeration system of claim 16, wherein said second warm liquid supply line includes a second warm liquid supply valve which can be opened or closed to selectively control the supply of warm coolant to said low temperature refrigerated space heat exchanger.

18. The refrigeration system of claim 6, wherein said secondary refrigeration loop of said low temperature side includes a second coolant shut-off valve for stopping the flow of coolant to said low temperature refrigerated space heat exchanger during a defrost cycle.

19. A warm liquid defrost refrigeration system comprising:

a medium temperature side having a primary refrigeration loop including a compressor, a condenser, an expansion device, and a first side of a medium temperature chiller, and further having a secondary refrigeration loop including a pump, a medium temperature refrigerated space heat exchanger, and a second side of said medium temperature chiller;

a low temperature side having a primary refrigeration loop including a compressor, a condenser, an expansion device, and a first side of a low temperature chiller, and further having a secondary refrigeration loop including a pump, a low temperature refrigerated space heat exchanger, and a second side of said low temperature chiller;

a medium temperature defrost heat exchanger having a hot side and a cold side, said hot side of said medium temperature defrost heat exchanger being connected to said primary refrigeration loop of said low temperature side such that refrigerant from said low temperature side can flow through said hot side of said medium temperature defrost heat exchanger, said cold side of said medium temperature defrost heat exchanger being connected to said secondary refrigeration loop of said medium temperature side with a first crossover coolant supply line such that coolant from said medium temperature side secondary refrigeration loop can be selectively transported via said first crossover coolant supply line to said cold side of said medium temperature defrost heat exchanger, said cold side of said medium temperature defrost heat exchanger further being connected to said medium temperature refrigerated space heat exchanger with a first warm liquid supply line; and a low temperature defrost heat exchanger having a hot side and a cold side, said hot side of said low temperature defrost heat exchanger being connected to said primary refrigeration loop of said medium temperature side such that refrigerant from said medium temperature side can flow through said hot side of said low temperature defrost heat exchanger, said cold side of said low temperature defrost heat exchanger being connected to said secondary refrigeration loop of said low temperature side with a second crossover coolant supply line such that coolant from said low temperature side can be selectively transported from said low temperature side secondary refrigeration loop via said second crossover coolant supply line to said cold side of said low temperature defrost heat exchanger, said cold side of said low temperature defrost heat exchanger further being connected to said low temperature refrigerated space heat exchanger with a second warm fluid supply line;

wherein during a low temperature side defrost cycle coolant from said low temperature side secondary refrigeration loop is heated by the refrigerant of said medium temperature side, and during a medium temperature side defrost cycle coolant from said medium temperature side secondary refrigeration loop is heated by the refrigerant of said low temperature side.

20. The refrigeration system of claim 19, wherein said first crossover coolant supply line includes a first diverting valve which can be opened or closed to selectively control the supply of coolant to said medium temperature defrost heat exchanger.

21. The refrigeration system of claim 19, wherein said first warm liquid supply line includes a first warm liquid supply valve which can be opened or closed to selectively control the supply of warm coolant to said medium temperature refrigerated space heat exchanger.

22. The refrigeration system of claim 19, wherein said secondary refrigeration loop of said medium temperature side includes a first coolant shut-off valve positioned between said medium temperature chiller and said medium temperature refrigerated space heat exchanger for stopping the flow of coolant to said medium temperature refrigerated space heat exchanger during a defrost cycle.

23. The refrigeration system of claim 19, wherein said secondary refrigeration loop of said low temperature side connects to said cold side of said low temperature defrost heat exchanger with a second crossover coolant supply line.

24. The refrigeration system of claim 19, wherein said second crossover coolant supply line includes a second diverting valve which can be opened or closed to selectively control the supply of coolant to said low temperature defrost heat exchanger.

25. The refrigeration system of claim 19, wherein said second warm liquid supply line includes a second warm liquid supply valve which can be opened or closed to selectively control the supply of warm coolant to said low temperature refrigerated space heat exchanger.

26. The refrigeration system of claim 19, wherein said secondary refrigeration loop of said low temperature side includes a second coolant shut off valve position between said low temperature chiller and said low temperature refrigerated space heat exchanger for stopping the flow of coolant to said low temperature refrigerated space heat exchanger during a defrost cycle.

27. A method for warming coolant for warm liquid defrost in a secondary coolant refrigeration system comprising a medium temperature side having a primary refrigeration system including a compressor and a condenser and a secondary refrigeration system including a pump and a medium temperature refrigerated space heat exchanger, and further comprising a low temperature side including a compressor and a condenser and a secondary refrigeration system including a pump and a low temperature refrigerated space heat exchanger, said method comprising the steps of:

providing a low temperature defrost heat exchanger having a hot side and a cold side;

transporting low temperature coolant from the pump of the low temperature side through the cold side of the low temperature defrost heat exchanger while simultaneously transporting high temperature refrigerant from the medium temperature side through the hot side of the low temperature defrost heat exchanger such that the coolant of the low temperature side is heated by the refrigerant of the medium temperature side; and transporting the heated coolant from the cold side of the low temperature defrost heat exchanger to the low temperature refrigerated space heat exchanger to melt any frost formed on the low temperature refrigerated space heat exchanger.

28. The method of claim 27, further comprising the steps of transporting low temperature coolant from the pump of the medium temperature side through the cold side of the medium temperature defrost heat exchanger while simultaneously transporting high temperature refrigerant from the low temperature side through the hot side of the medium temperature defrost heat exchanger such that the coolant of the medium temperature side is heated by the refrigerant of the low temperature side, and transporting the heated coolant from the cold side of the medium temperature defrost heat exchanger to the medium temperature refrigerated space heat exchanger to melt any frost formed on the medium temperature refrigerated space heat exchanger.

29. The method of claim 27, wherein coolant is transported from the medium and low temperature side pumps to the respective medium and low temperature defrost heat exchangers with first and second crossover coolant supply lines, respectively.

30. The method of claim 29, further comprising the step of selectively opening and closing first and second diverting valves provided in the first and second crossover coolant supply lines, respectively, to selectively control the supply of coolant to the medium and low temperature defrost heat exchangers, respectively.

31. The method of claim 27, wherein coolant is transported from the medium and low temperature defrost heat exchangers to the respective medium and low temperature refrigerated space heat exchangers with first and second warm liquid supply lines, respectively.

32. The method of claim 31, further comprising the step of selectively opening and closing first and second warm liquid supply valves provided in the first and second warm liquid supply lines, respectively, to selectively control the supply of warm coolant to the medium and low temperature refrigerated space heat exchangers, respectively.

33. The method of claim 27, further comprising the step of selectively opening and closing first and second coolant shut-off valves to selectively stop the supply of coolant to the medium and low temperature refrigerated space heat exchangers, respectively, during defrost cycles.

34. The method of claim 27, wherein the refrigeration system further includes control means for controlling the initiation and termination of defrost cycles.

35. The method of claim 34, wherein the control means comprises a microprocessor which automatically initiates and terminates the defrost cycles according to a pre-programmed schedule.

36. The method of claim 27, wherein the medium and low temperature defrost heat exchangers are liquid-to-liquid plate heat exchangers.

* * * * *